United States Patent [19]

Richter et al.

[11] 4,092,212

[45] May 30, 1978

[54] SELECTIVE IMPREGNATION OF HETEROGENOUS FIBER MATERIAL BEFORE DIGESTION

[75] Inventors: Johan C. F. C. Richter, Nice, France; Ole Johan Richter, Karlstad, Sweden

[73] Assignee: Kamyr Aktiebolag, Karlstad, Sweden

[21] Appl. No.: 744,977

[22] Filed: Nov. 24, 1976

[30] Foreign Application Priority Data

Nov. 25, 1975 Sweden ..... 7513217

[51] Int. Cl.[2] ..... D21C 3/24; D21C 3/26; D21C 7/06

[52] U.S. Cl. ..... 162/19; 162/237; 162/246; 162/DIG. 2

[58] Field of Search ..... 162/17, 19, 237, 246, 162/DIG. 2

[56] References Cited

U.S. PATENT DOCUMENTS

| | | | |
|---|---|---|---|
| 3,579,418 | 5/1971 | Ostberg | 162/19 |
| 3,586,600 | 6/1971 | Rich et al. | 162/237 |
| 4,028,171 | 6/1977 | Richter | 162/246 |

*Primary Examiner*—Richard V. Fisher
*Assistant Examiner*—William F. Smith
*Attorney, Agent, or Firm*—Cushman, Darby & Cushman

[57] ABSTRACT

Impregnation of fiber material before digestion is accomplished utilizing a minimum amount of equipment. Liquid with entrained fiber material — both fiber material sufficiently impregnated with liquid to be denser than the liquid and material insufficiently impregnated to be denser than the liquid — is fed from a high-pressure transfer valve to an inlet at the top of a continuous digester. The digester has an outlet disposed vertically above the inlet, and liquid along with fiber material of lesser density than the liquid is withdrawn from the outlet. The withdrawn liquid and fiber material is recirculated back to the transfer valve through a conduit adapted to allow the passage of fiber material entrained in liquid therethrough. Each individual portion of fiber material is continuously circulated until it becomes sufficiently impregnated with liquid to descend into the digester and form a fiber column therein.

2 Claims, 1 Drawing Figure

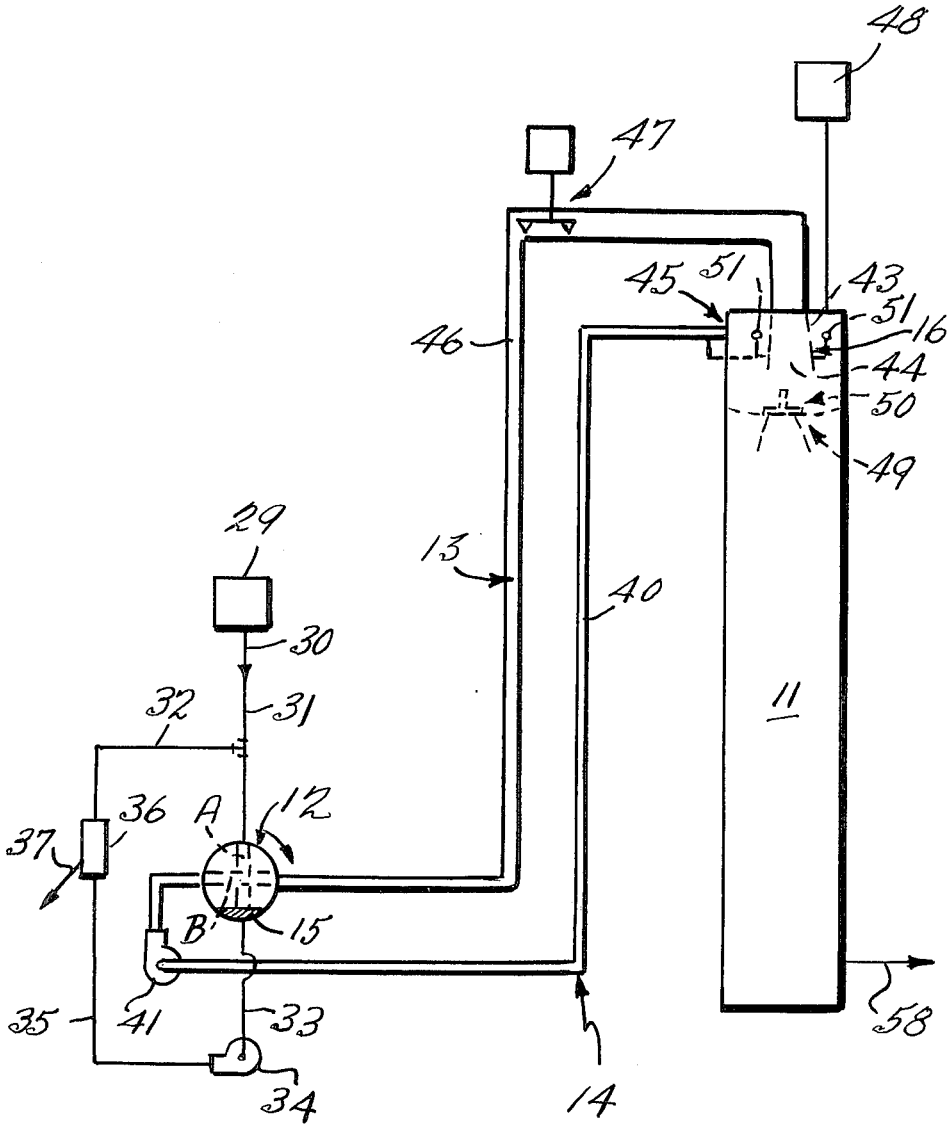
48
47
45
51
43
51
16
46
44
50
49
29
13
40
30
11
32
31
36
A
12
37
B
15
35
41
33
58
34
14

SELECTIVE IMPREGNATION OF HETEROGENOUS FIBER MATERIAL BEFORE DIGESTION

BACKGROUND AND SUMMARY OF THE INVENTION

The invention is related to continuous digestion of fiber material and especially impregnation of the fiber material during transport to a digester. Such pre-impregnation of fiber material comprises a very important part of the delignification process and has as an object to replace the air or gas content of the fiber material with an impregnation liquid or with cooking liquor.

The driving off of air or gas in fiber material so that it may be impregnated is commonly done by means of steaming at a relatively small superatmospheric pressure with succeeding submerging into cooking liquor at higher pressure and temperature but also by means of other methods, e.g., first vacuum treatment or pressing and then submerging into a liquid before the cooking starts. Whether the impregnation is performed in one way or the other, certain equipment is needed which both, from an economical as well as from a space point of view, is to be limited as much as possible during simultaneous consideration that the impregnation should be as effective as possible. Fiber material, such as it arrives to a cooking installation, is made up of a heterogenous mixture of comminuted raw material, e.g., wood, grass, reeds, straw, etc. Even if coarse screening has been done, the variations from piece to piece are considerable both in size, shape and density. Especially with mixed raw material and with the popular use of "whole trees" as the raw material, the differences and the need for selective impregnation are accentuated.

According to the present invention, an effective impregnation is effected (possibly after steaming) by means of varying impregnation time in a simple and effective manner while the fiber material is surrounded by liquid. In this way, the heterogenous character of the fiber material is compensated for, and the pulp yield, evenness and strength characteristics are improved. Impregnation with time variations for separate fiber material particles is in itself previously known, e.g, through Swedish Pat. No. 174,656. The mentioned patent has as its main characterizing part, in an impregnation space separate from the digester itself, replacement of the air in the fiber material cells by cooking liquid by means of pressure variations and by provision of a selective impregnation of the fiber material in such a manner that the fast impregnatable fiber material is removed earlier from the impregnation space than the more difficult impregnatable fiber material. The impregnation process takes place in a standing impregnation vessel arranged at an angle to the horizontal plane, to which a mixture of fiber material and cooking liquor under pressure is fed by means of a first device and fed out by means of another device. The vessel is equipped on the inside with a screw conveyor for fiber material which has sunk in the cooking liquor and, at the same time, air is being expelled through a valve and the pressure variations are obtained by a vacuum pump and/or by tapping off liquid respectively by pumping in of cooking liquor and/or by use of pressure accumulators.

Improved impregnation can be effected according to the present invention in a simple and economically advantageous way be in connection with a Kamyr conventional continuous digester, the transition of fiber material from low to high pressure being accomplished by a conventional Kamyr high-pressure feeder. The fiber material is transported in liquid which is pumped to the digester top where the liquid is separated and returned back to the high-pressure feeder for renewed use as transport medium. Such a feed system is per se known, as illustrated by U.S. Pat. No. 3,802,956. In U.S. Pat. No. 3,802,956, from a high-pressure feeder, fiber material and liquid are pumped through a line up to the top of an impregnation vessel (separate from the digester) where liquid is separated off by a screen assembly and led back to the pump through a return line. The high-pressure feeder is conventional and primarily consists of a rotor equipped with through-going pockets in a housing equipped with inlet and outlet connections. When a rotor pocket is in vertical position, a mixture of liquid and fiber material is fed into the feeder, and in order to make the filling more effective, liquid is extracted at the lower end of the feeder housing through a screen to a pump which circulates liquid back to the feed-in line. Before the high-pressure feeder, the fiber material and liquid are normally at a small superatmospheric pressure of about 1 atm, while in transfer valve, high-pressure line fiber material and liquid can be exposed to a pressure corresponding to the cooking pressure, e.g., 10 atm. The pockets and the housing of the high-pressure feeder are designed so that one of the pockets is always being filled at the same time as another pocket is being emptied, whereby the flow of fiber material in the transfer line is continuous. Before the fiber material arrives at the high-pressure feeder, it has usually been treated with steam, whereby the greater part of the air has been driven out of the pores of the fiber material. The real impregnation with cooking liquor takes place during entrance into the cooking liquor which circulates through the high-pressure feeder and through the feeding line to the top part of the digester at full cooking pressure, whereby the greater part of the fiber material quantity, e.g., by means of a screen device, is separated from the transport liquid which, in the above-mentioned manner, is led back to the circulation pump. If the separation of transport liquid and fiber material in the digester top is done in a conventional manner with a so-called top screw surrounded by a concentric screen plate, mainly the smallest fiber particles which can pass the screen openings will follow the transport liquid back to the circulation pump, feeding apparatus — feeder, and back to the digester top again until the particles fasten on any larger fiber particle and continue downwards in the digester. This extra circulation which means an extra impregnation time is generally undesirable since the small particles which can pass the screen in the digester top already are thoroughly impregnated and, therefore, do not need an extra impregnation time. Instead, it is desirable that larger fiber particles which are not sufficiently impregnated should receive an extra retention time before they are digested. This has been accomplished according to the invention in a surprisingly simple and effective manner.

According to the present invention, the fiber material that should have a longer retention time in impregnating liquid is retained longer, while the fiber material that does not need a longer retention time is not, by the substitution of a stilling well for the inlet-outlet arrangement at the top of the digester instead of the screw-feeder with screen as is conventional (see U.S. Pat. No.

3,802,956), and by directly connecting the high-pressure transfer valve to the stilling well. This allows the elimination of the impregnation vessel in U.S. Pat. No. 3,802,956 and in copending application Ser. No. 719,656, without subsequent loss of its function — that is, proper impregnation of all of the fiber material is still achieved. While the utilization of a stilling well per se is known (see German Offenlegungsschrift No. 2,361,627) previously in the utilization of such a stilling well the practice has been to separate out all of the particles from the liquid while not utilizing screens and, therefore, such stilling wells have only been utilized in areas where the fiber material is always more dense than the liquid, or accessory means were employed to facilitate removal of the fiber material (see copending application Ser. No. 659,638). The method and apparatus according to the present invention are distinct from the prior art in that by design, a selected portion of the fiber material is recirculated with the liquid withdrawn from the stilling well and that selected fiber material is subjected to impregnation conditions for sufficient additional time so that eventually impregnation does take place before digestion.

In mill operation, the practice has been to install steaming/impregnation apparatus designed so that a large part of the raw material will be completely or in any case sufficiently impregnated, while a smaller part will remain "hungry" for chemicals, and this latter raw material part will, after treatment, remain partly uncooked, i.e., higher reject, especially at higher yields. It is typical that, depending upon the degree of impregnation, a portion of fiber material (e.g., chips) tends to either sink or to float. A chip can sink in water but still float in cooking liquor with higher specific weight. A chip piece which sinks in cooking liquor can generally be designated as sufficiently impregnated.

The present invention takes advantage of this physical phenomenon in order to reduce the total dimensions of the equipment through selective separation of "sinkers" and "floaters", especially in an established feed system for a continuous digester, in that the "sinkers" sink down in the digester cooking zone while the "floaters", which normally constitute a relatively small part of the total quantity, pass through the impregnation process a second time.

It is the primary object of the present invention to provide a simplified but effective method and apparatus for complete impregnation of all fiber material from a heterogenous source before digestion of that fiber material. This and other objects of the invention will become apparent from the detailed description of the invention and from the appended claims.

BRIEF DESCRIPTION OF THE DRAWINGS

The drawing provides a schematic illustration of exemplary apparatus according to the invention for accomplishing the method of the invention.

DETAILED DESCRIPTION OF THE INVENTION

In the drawing, 11 is a conventional Kamyr continuous digester, 12 is a conventional Kamyr high-pressure feeder, 13 comprises means for directly connecting the transfer valve 12 to the digester 11 so that liquid containing fiber material is transferred to the digestive 11 from the transfer valve 12 under pressure, and 14 comprises means for withdrawing from the digester 11 liquid and fiber material insufficiently impregnated with liquid so that it has a density lesser than the density of the liquid while allowing fiber material sufficiently impregnated with said liquid so that it has a density greater than the density of the liquid to descend into and form a column in the digester 11, and means for directly recirculating the liquid and insufficiently impregnated fiber material back to the transfer valve 12 under pressure.

The function of the conventional high-pressure feeder 2 briefly is as follows: A feeder rotor pocket (A) in vertical position is filled with fiber material, as shown by arrow 30, through the line 31 together with liquid from line 32 which can consist of suitable impregnation liquid or liquid intended for the cooking process itself. In the feeder housing lower part, a liquid quantity is extracted through a screen 15 to a line 33 and further to a pump 34, which liquid is pumped further through a line 35 back to the line 32 through a screening device 36 in which a part of the liquid corresponding to the displacement of the fiber material in the feeder rotor pocket is extracted, such as shown by arrow 37. Through this circulation of liquid by means of pump 34, an effective filling of each feeder rotor pocket is secured. When later on a rotor pocket which now is completely or partly filled with fiber material and liquid after turning of the feeder rotor comes into horizontal position (B), the pocket with its content enters a circulation of liquid at relatively high pressure corresponding to the digester pressure. The liquid is extracted and recirculated by means 14 which includes line 40 and pump 41. Through the line 42, liquid is pumped into a horizontally positioned rotor pocket (B) and the liquid transports the pocket content of fiber material and liquid through the means to the digester 11. The means 13 leads concentrically into the digester top area 16. The digester inlet includes a funnel-shaped pipe 43 (downwards expanding conical pipe 43) which penetrates a distance into the space 16. Under the opening 44 of the pipe 43, a column of sinking fiber material will be formed while above the opening 44, from the liquid chamber 16, liquid can be extracted through line 40. With this system, a so-called "screenless separation" takes place. The digester outlet 45 is disposed vertically above the inlet opening 44.

The means 13 may comprise a conduit 46, and the conduit may be designed to increase the time of retention of fiber material entrained in liquid therein before being fed to the digester 11.

If longer retention time is desired for the impregnation, the conduit 46 can suitably have a relatively large diameter or possibly be conically designed with a gradually increasing cross-section in the direction of the flow on to the funnel 43. Other shapes of the conduit 46 also can be used, e.g., if the line in the vertical part of the pipe is shaped as a long vessel, from which top the fiber material and liquid by means of the liquid flow or by means of a mechanical feeding device (i.e., a rotating scraper 47) is fed out through a short pipe line to the funnel 43.

Means 48 may be provided at the top of chamber 16 for removing gas that is displaced by the liquid during impregnation. Also, the chamber 16 could be slightly conically shaped and have a lower termination consisting of a bottom with a concentrical outlet to the cooking zone (see dotted structure 49). Above this bottom, a scraper (50) can be placed in order to facilitate the feeding of fiber material to the underlying cooking zone in the digester, where higher temperature is maintained, as shown in U.S. Pat. No. 4,028,171.

The described apparatus functions as follows: Steamed fiber material which most often consists of finely comminuted wood or finely comminuted other raw material of, e.g., bamboo, bagasse, grass, reeds or straw, in a continuous flow 30 is fed in through line 31 to the high-pressure feeder 12, through which two circulations are maintained. The one circulation for filling of the high-pressure feeder pockets takes place by means of pump 34 and surplus liquid is fed out through line 37, which liquid normally is united with added fresh cooking liquor. The other circulation through the high-pressure feeder takes place by means of pump 41 and means 13. The digester 11 and the chamber 16 are kept essentially completely liquid-filled as is the means 13 and the funnel 43. The digester is kept at a superatmospheric pressure necessary for cooking, e.g., 10–20 atm, which is higher than the pressure corresponding to the temperature. Thereby steam development is prohibited and the sinking tendency of the chips is increased. In the digester, a heating of the fiber material takes place by a conventional (not shown) heating device and by use of a circulation system of cooking liquor to the desired temperature, e.g., 170° C. In the digester, counter-current washing can take place in another circulation, which is not shown since it has no influence on the explanation of the invention. Fiber material which has been treated is fed in a continuous flow out through the line 58 to succeeding treatment stages which are not shown but which, e.g., can consist of a continuous diffuser washing installation.

Fiber material 30 can, e.g., have been precedingly steamed in a steaming vessel 29 at a superatmospheric pressure of about 1 atm. When a rotor pocket in the high-pressure feeder 2 has turned to horizontal position (B), the fiber material is suddenly exposed to, in principal, the same pressure as in the digester top, if the difference in static pressure is excluded, thereby the fiber material undergoes a pressure impregnation at a temperature lower than the real cooking temperature during a time which corresponds to the transport time from the high-pressure feeder 12 to the place where the fiber material, as mentioned, is heated in the digester itself. This time can be increased if the conduit 46 is made larger or vessel-shaped, conical or cylindrical, as above described, but the pressure conditions are still the same as mentioned. The main part of the fiber material will build up a level at or slightly below the opening 44 below the funnel.

Fiber material which does not sink and form a column at the funnel opening 44, but which floats up, i.e., follows the liquid upwards through the liquid chamber 16, follows the liquid through the return pipe 40, passes the pump 41 and the feeder 12, and returns after a certain time to the digester through means 13 and funnel 43. If the fiber material, after this extra impregnation time, still is not really impregnated so that it sinks during the prevailing pressure conditions, it can in principle be returned still more times and circulated back to the digester. During "round travel", the fiber material is exposed to the variation of pressure corresponding to the difference in static height between the digester top and the high-pressure feeder. With the digester of up to 100 m height, the difference can be rather great and still more influence on the impregnation procedure in a favorable direction. In order to make the recirculation of fiber material possible, especially the line 40 and the pump 41 must be given a suitable design. The line 40 must have a cross-section and bends so that fiber material pieces can pass therethrough. Suitably, the line 40 can extend into the chamber 16 and there may be provided two or more evenly distributed outlet openings 51 so that an even extraction can be obtained over the cross-section of the chamber 16. The pump 41 must be equipped with rotor and housing which can permit the passing of fiber parts of the size which it is here question about. The feeder 12 and the conduit 46 are normally made for transport of fiber material and liquid and, therefore, no alterations have to be made to these conventional parts. The method and the device according to the invention can, as is readily understood from the above description, be employed in existing installations with a minimum of rebuilding.

Through the invention, it is possible in a normal liquid feeding of fiber material to a continuous digester to obtain an improvement of the fiber material impregnation with cooking liquor. The invention can be used in principally all continuous cooking processes since for all of them it is of importance to obtain as even and effective and impregnation, with special impregnating liquid, or cooking liquor of the fiber material as possible. The system with the high-pressure feeder 12, which without mechanical action on the fiber material feeds fiber material in a liquid circulation from a relatively low to a relatively high pressure and which in hundreds of installations in practical operation has proved to be a very reliable and technically good piece of machinery is thus even further varied in function.

While the invention has been herein shown and described in what is presently conceived to be the most practical and preferred embodiment, it will be apparent to those or ordinary skill in the art that many modifications may be made thereof within the scope of the invention which scope is to be accorded the broadest interpretation of the appended claims so as to encompass all equivalent structures and methods.

What is claimed is:

1. A method for selective impregnation of fiber material before digestion thereof using a high-pressure valve connected to a continuous digester at a digester inlet adjacent the top thereof, the digester having an outlet disposed vertically above the digester inlet, said method comprising the steps of (a) continuously feeding to the transfer valve under low-pressure liquid with entrained fiber material;

(b) continuously feeding from the transfer valve liquid under high pressure specifically containing both (i) fiber material sufficiently impregnated with said liquid and (ii) fiber material insufficiently impregnated with said liquid so that it has a density lesser than that of the liquid, directly to the continuous digester inlet;

(c) withdrawing liquid from the digester outlet at the top of the digester along with the fiber material of a density lesser than that of the liquid, while the fiber material with a density greater than that of the liquid descends into and forms a column in the digester;

(d) recirculating the withdrawn liquid and the fiber material of lesser density under pressure to the high-pressure transfer valve; and (e) continuously repeating steps (b)–(d) so that each individual portion of fiber material eventually will become sufficiently impregnated with liquid so that it will descend into and form a column in the digester.

2. A method as recited in claim 1 wherein said step of recirculating said withdrawn liquid and fiber material of lesser density under pressure is accomplished by subjecting the fiber material to pressure variations as a result of drastically changing the vertical position of the fiber material during recirculation.

* * * * *